US011877592B2

(12) United States Patent
Cheong et al.

(10) Patent No.: US 11,877,592 B2
(45) Date of Patent: Jan. 23, 2024

(54) AEROSOL-GENERATING ARTICLE

(71) Applicant: KT&G CORPORATION, Daejeon (KR)

(72) Inventors: Bong Su Cheong, Daejeon (KR); Dong Kyun Ko, Sejong (KR); Jae Sung Noh, Cheonan-si (KR); Sang Won Choi, Daejeon (KR); Jung Seop Hwang, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 185 days.

(21) Appl. No.: 16/966,731

(22) PCT Filed: Nov. 13, 2019

(86) PCT No.: PCT/KR2019/015412
§ 371 (c)(1),
(2) Date: Jul. 31, 2020

(87) PCT Pub. No.: WO2020/105940
PCT Pub. Date: May 28, 2020

(65) Prior Publication Data

US 2020/0352220 A1 Nov. 12, 2020

(30) Foreign Application Priority Data

Nov. 23, 2018 (KR) ..... 10-2018-0146529

(51) Int. Cl.
*A24D 1/20* (2020.01)
*A24D 3/17* (2020.01)
(Continued)

(52) U.S. Cl.
CPC ..... *A24D 1/20* (2020.01); *A24D 1/045* (2013.01); *A24D 3/04* (2013.01); *A24D 3/17* (2020.01); *A24F 40/20* (2020.01)

(58) Field of Classification Search
CPC . A24D 1/20; A24D 3/17; A24D 3/045; A24D 3/04; A24F 40/20
See application file for complete search history.

(56) References Cited

U.S. PATENT DOCUMENTS 4,413,641 A * 11/1983 Dwyer, Jr. ..... A24D 3/045 131/330
6,422,244 B1 7/2002 Clarke et al.
(Continued)

FOREIGN PATENT DOCUMENTS

CN 104768405 A 7/2015
CN 107635416 A 1/2018
(Continued)

OTHER PUBLICATIONS

Extended European Search Report dated Dec. 3, 2021 from the European Patent Office in EP Application No. 19887859.7.
(Continued)

*Primary Examiner* — Kelly M Gambetta
*Assistant Examiner* — Stephanie Lynn Moore
(74) *Attorney, Agent, or Firm* — Sughrue Mion, PLLC

(57) ABSTRACT

Provided is an aerosol generating article including a filter segment in which a channel is formed, the aerosol generating article including: a front-end filter segment arranged at an upstream end that is to be inserted into an aerosol generating device; a rear-end filter segment arranged at a downstream end that is to contact a mouth of a user; and a tobacco rod arranged between the front-end filter segment and the rear-end filter segment, wherein at least one filter segment of the front-end filter segment and the rear-end filter segment includes: at least one channel extending from the upstream end toward the downstream end; and a filter structure filtering out some components of aerosol, and wherein the at least one filter segment has a suction resistance corresponding to a ratio between a cross-sectional area
(Continued)

of the at least one channel and a cross-sectional area of the filter structure.

11 Claims, 9 Drawing Sheets

(51) Int. Cl.

| | |
|---|---|
| ***A24D 1/04*** | (2006.01) |
| ***A24D 3/04*** | (2006.01) |
| ***A24F 40/20*** | (2020.01) |

(56) References Cited

U.S. PATENT DOCUMENTS

| | | | | |
|---|---|---|---|---|
| 10,231,482 | B2 | 3/2019 | Tritz et al. | |
| 11,083,213 | B2 | 8/2021 | Malgat et al. | |
| 2006/0185687 | A1 | 8/2006 | Hearn et al. | |
| 2015/0181929 | A1* | 7/2015 | Lisan | A24D 3/043 131/345 |
| 2016/0120216 | A1 | 5/2016 | Mironov et al. | |
| 2018/0000152 | A1 | 1/2018 | Ito et al. | |
| 2018/0007966 | A1* | 1/2018 | Li | A24F 40/40 |
| 2018/0168232 | A1* | 6/2018 | Reevell | A24F 40/70 |
| 2018/0177235 | A1 | 6/2018 | Minzoni | |
| 2019/0000134 | A1 | 1/2019 | Lavanant et al. | |
| 2019/0075845 | A1* | 3/2019 | Malgat | A24D 1/20 |
| 2020/0163380 | A1 | 5/2020 | Lee et al. | |
| 2021/0106051 | A1 | 4/2021 | Han et al. | |

FOREIGN PATENT DOCUMENTS

| | | | | |
|---|---|---|---|---|
| CN | 108601407 | A | 9/2018 | |
| JP | 59-203483 | A | 11/1984 | |
| JP | 06-327458 | A | 11/1994 | |
| JP | 2001-46044 | A | 2/2001 | |
| JP | 2001-120249 | A | 5/2001 | |
| JP | 2015-530106 | A | 10/2015 | |
| KR | 10-2003-0093631 | A | 12/2003 | |
| KR | 10-2015-0038392 | A | 4/2015 | |
| KR | 10-2016-0032025 | A | 3/2016 | |
| KR | 10-2018-0020136 | A | 2/2018 | |
| KR | 10-2018-0029203 | A | 3/2018 | |
| KR | 10-2018-0111460 | A | 10/2018 | |
| WO | 2013/060607 | A1 | 5/2013 | |
| WO | 2013/098410 | A2 | 7/2013 | |
| WO | 2016/156223 | A1 | 10/2016 | |
| WO | 2017/009298 | A1 | 1/2017 | |
| WO | 2017/153443 | A1 | 9/2017 | |
| WO | WO-2017153443 | A1 * | 9/2017 | A24D 1/20 |
| WO | 2017/207586 | A1 | 12/2017 | |
| WO | 2018/182322 | A1 | 10/2018 | |

OTHER PUBLICATIONS

Notice of Reasons for Refusal dated Aug. 31, 2021 from the Japanese Patent Office in JP Application No. 2020-542251.

International Search Report for PCT/KR2019/015412 dated Feb. 20, 2020 [PCT/ISA/210].

Notice of Reasons for Refusal dated Mar. 22, 2022 from the Japanese Patent Office in JP Application No. 2020-542251.

Chinese Office Action dated Jan. 5, 2023 in Chinese Application No. 201980010603.0.

* cited by examiner

AEROSOL-GENERATING ARTICLE

CROSS REFERENCE TO RELATED APPLICATIONS

This application is a National Stage of International Application No. PCT/KR2019/015412 filed Nov. 13, 2019, claiming priority based on Korean Patent Application No. 10-2018-0146529 filed Nov. 23, 2018.

TECHNICAL FIELD

The present disclosure relates to an aerosol generating article, and more particularly, to an aerosol generating article including a filter segment in which a channel is formed.

BACKGROUND ART

Recently, the demand for alternative methods to overcome the shortcomings of traditional aerosol generating articles (cigarettes) has increased. For example, there is growing demand for a method of generating aerosol by heating an aerosol generating material in aerosol generating articles, rather than by combusting aerosol generating articles.

An aerosol generating article includes a filter segment, and the filter segment filters out a particular component included in aerosol or cools the aerosol. The filter segment may allow the aerosol to be easily inhaled by user smoking, while at the same time filtering out particular components of the aerosol. Therefore, studies have been conducted to develop a filter segment having appropriate suction resistance.

DESCRIPTION OF EMBODIMENTS

Technical Problem

Provided is an aerosol generating article including a filter segment at its end, which includes a channel such that suction resistance of the aerosol generating article may be adjusted according to a cross-sectional area of the channel.

Solution to Problem

According to an aspect of the present disclosure, an aerosol generating article may include: a front-end filter segment arranged at an upstream end that is to be inserted into an aerosol generating device; a rear-end filter segment arranged at a downstream end that is to contact a mouth of a user; and a tobacco rod arranged between the front-end filter segment and the rear-end filter segment, wherein at least one filter segment of the front-end filter segment and the rear-end filter segment includes: at least one channel extending from the upstream end toward the downstream end; and a filter structure filtering out some components of aerosol, wherein the at least one filter segment has suction resistance corresponding to a ratio between a cross-sectional area of the at least one channel and a cross-sectional area of the filter structure.

ADVANTAGEOUS EFFECTS OF DISCLOSURE

Suction resistance of an aerosol generating article may be adjusted by adjusting a ratio (porosity) of a cross-sectional area of a channel to a cross-sectional area of a filter structure. Also, an aerosol may be easily passed through a channel formed in a filter segment while simultaneously filtering out components of the aerosol through a filter structure.

Effects of the aerosol generating article are not limited by the examples described above, and more various effects are included herein.

BEST MODE

Figure 1:
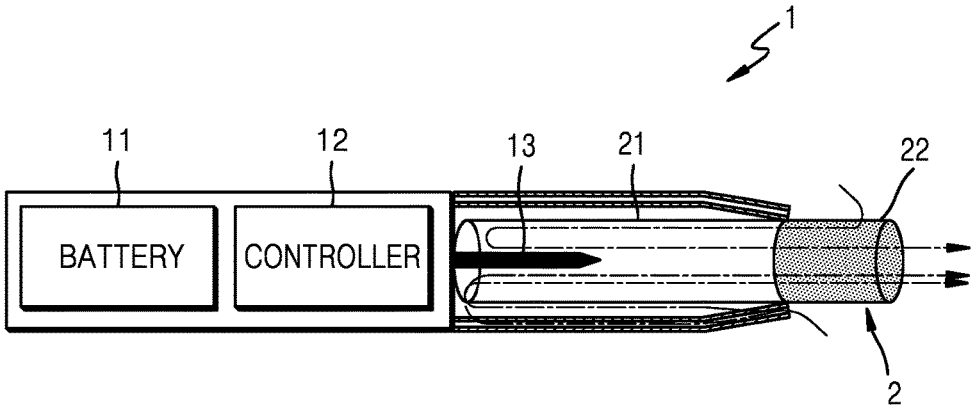
FIGS. 1 through 3 are views illustrating examples in which an aerosol generating article is inserted into an aerosol generating device.

According to an aspect of the present disclosure, an aerosol generating article may include: a front-end filter segment arranged at an upstream end that is to be inserted into an aerosol generating device; a rear-end filter segment arranged at a downstream end that is to contact a mouth of a user; and a tobacco rod arranged between the front-end filter segment and the rear-end filter segment, wherein at least one filter segment of the front-end filter segment and the rear-end filter segment includes: at least one channel extending from the upstream end toward the downstream end; and a filter structure filtering out some components of an aerosol, wherein the at least one filter segment has a suction resistance corresponding to a ratio between a cross-sectional area of the at least one channel and a cross-sectional area of the filter structure.

The at least one filter segment may have a suction resistance within a range of 1 mmWG/mm to 30 mmWG/mm.

The ratio of the cross-sectional area of the at least one channel to the cross-sectional area of the filter structure may have a value within a range of 0.02 to 1.47.

A cross-sectional shape of the at least one channel may be a circular or multi-leaf shape.

The at least one channel may include a plurality of channels, wherein the plurality of channels are arranged between the filter structure and a wrapper surrounding the at least one filter segment, and the filter structure includes a plurality of leg portions that extend from the center of the filter structure between the plurality of channels.

The at least one channel may include a plurality of channels, wherein the plurality of channels are different in at least one of a location, a cross-sectional shape, and a cross-sectional area.

A cross-sectional area of the at least one channel at one point may be different from a cross-sectional area of the at least one channel at another point.

An area of an upstream-end opening of the at least one channel may be greater than an area of a downstream-end opening of the at least one channel.

A normal of an opening of the at least one channel may meet the filter structure.

At least one channel formed in the front-end filter segment and at least one channel formed in the rear-end filter segment may be different in at least one of a cross-sectional shape, a cross-sectional area, and a number.

According to another aspect of the present disclosure, an aerosol generating article may include: a tobacco rod arranged at an upstream end that is to be inserted into an aerosol generating device; and a rear-end filter segment arranged at a downstream end that is to contact a mouth of a user, wherein the rear-end filter segment includes: at least one channel extending from the upstream end toward the downstream end; and a filter structure filtering out some components of an aerosol, wherein the at least one filter segment has a suction resistance corresponding to a ratio between a cross-sectional area of the at least one channel and a cross-sectional area of the filter structure.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used may be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

In the following embodiments, with respect to the terms "upstream" and "downstream", when a user draws air by using a smoking article, a portion where air is introduced into an aerosol generating article from the outside is "upstream" and a portion where air is discharged from an inside of the aerosol generating article to the outside is "downstream". The terms "upstream" and "downstream" are terms used to indicate relative locations or orientations between segments constituting an aerosol generating article.

In the following embodiments, the term "longitudinal direction" indicates a longitudinal direction of an aerosol generating article, and the term "diameter direction" indicates a shortening direction of the aerosol generating article. In other words, the "diameter direction" refers to a direction perpendicular to the "longitudinal direction".

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the accompanying drawings.

Figure 2:
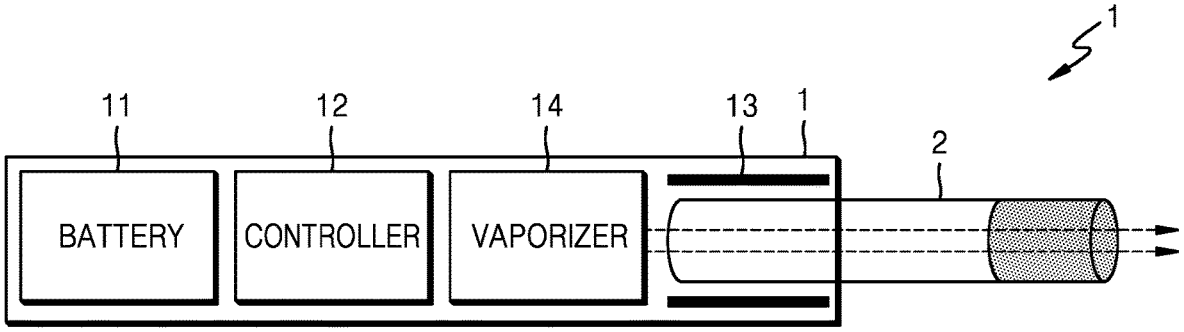
Figure 3:
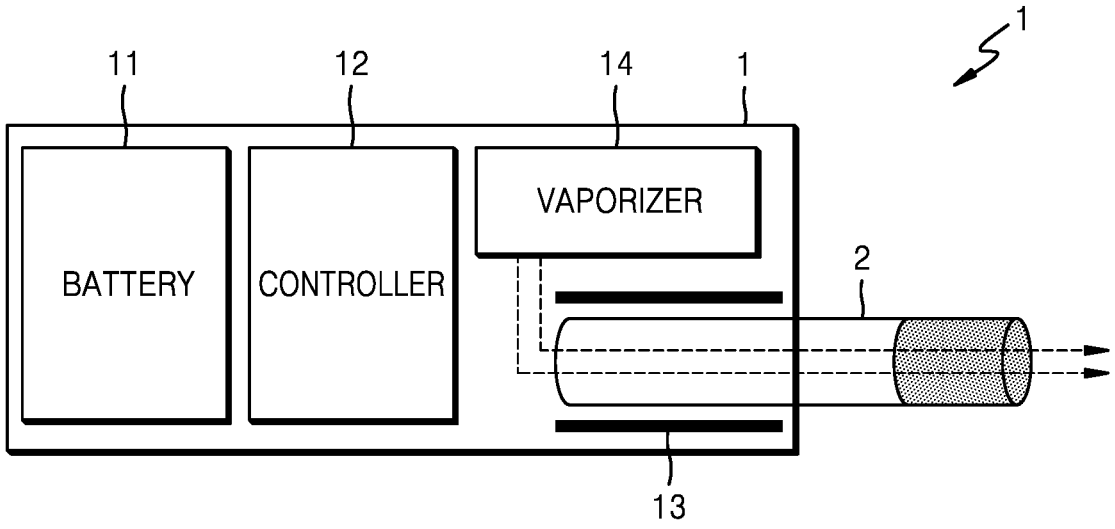

FIGS. 1 through 3 are diagrams showing examples in which an aerosol generating article is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the aerosol generating article 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

FIG. 1 illustrates that the battery 11 the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the aerosol generating article 2 is inserted into the aerosol generating device 1, the aerosol generating device 1 may operate the heater 13 and/or the vaporizer 14 to generate an aerosol. The aerosol generated by the heater 13 and/or the vaporizer 14 is delivered to a user by passing through the aerosol generating article 2.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may control overall operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the aerosol generating article 2 is inserted into the aerosol generating device 1, the heater 13 may be located inside or outside the aerosol generating article 2. Thus, the heated heater 13 may increase a temperature of an aerosol generating material in the aerosol generating article 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating an aerosol generating article in an induction heating method, and the aerosol generating article may include a susceptor which may be heated by the induction heater.

For example, the heater 13 may include a tube-type heating element, a plate-type heating element, a needle-type heating element, or a rod-type heating element, and may heat the inside or the outside of the aerosol generating article 2, according to the shape of the heating element.

Also, the aerosol generating device 1 may include a plurality of heaters 13. Here, the plurality of heaters 13 may be inserted into the aerosol generating article 2 or may be arranged outside the aerosol generating article 2. Also, some of the plurality of heaters 13 may be inserted into the aerosol generating article 2 and the others may be arranged outside the aerosol generating article 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the aerosol generating article 2 to be delivered to a user. In other words, the aerosol generated via the vaporizer 14 may move along an air flow passage of the aerosol generating device 1 and the air flow passage may be configured such that the aerosol generated via the vaporizer 14 passes through the aerosol generating article 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include general-purpose components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor. Also, the aerosol generating device 1 may be formed as a structure where, even when the aerosol generating article 2 is inserted into the aerosol generating device 1, external air may be introduced or internal air may be discharged.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated while the cradle and the aerosol generating device 1 are coupled to each other.

The aerosol generating article 2 may be similar to a general combustive aerosol generating article. For example, the aerosol generating article 2 may be divided into a first portion including an aerosol generating material and a second portion including a filter, etc. The second portion of the aerosol generating article 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1. Otherwise, the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage may be adjusted by the user. Accordingly, the amount and quality of vapor may be adjusted by the user. As another example, the external air may flow into the aerosol generating article 2 through at least one hole formed in a surface of the aerosol generating article 2.

Hereinafter, an example of the aerosol generating article 300 will be described with reference to FIG. 4.

Figure 4:
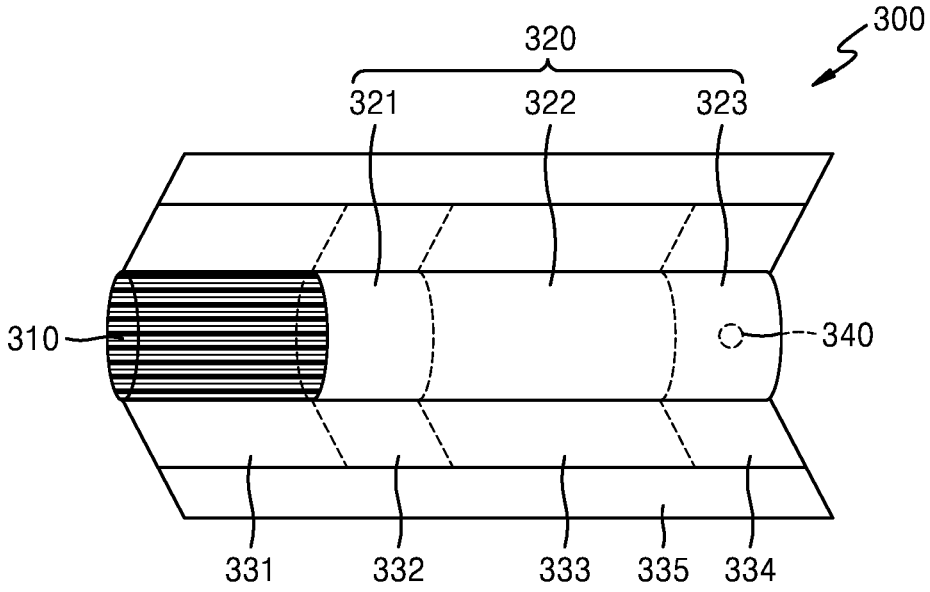
FIGS. 4 and 5 are views illustrating examples of an aerosol generating article.

Referring to FIG. 4, the aerosol generating article 300 may include a tobacco rod 310 and a filter rod 320. The first portion described above with reference to FIGS. 1 through 3 may include the tobacco rod 310, and the second portion may include the filter rod 320.

The aerosol generating article 300 may have a diameter within a range of about 5 mm to about 9 mm and a length of about 48 mm, but an embodiment is not limited thereto. For example, a length of the tobacco rod 310 may be about 12 mm, a length of a first filter segment 321 may be about 10 mm, a length of a second filter segment 322 may be about 14 mm, and a length of a third filter segment 323 may be about 12 mm, but embodiments are not limited thereto.

The aerosol generating article 300 may be packaged by wrappers 331, 332, 333, 334, and 335. For example, the tobacco rod 310 may be wrapped by the wrapper 331, and the filter rod 320 may be packaged by the wrappers 332, 333, and 334. Also, the tobacco rod 310 and the filter rod 320 wrapped by the wrappers 331, 332, 333, and 334 may be coupled to each other, and the entire aerosol generating article 300 may be repackaged by the wrapper 335.

The tobacco rod 310 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 310 may include other additives, such as flavors, a wetting agent, and/or organic acid. Also, the tobacco rod 310 may include a flavored liquid, such as menthol or a moisturizer, which is injected to the tobacco rod 310.

The tobacco rod 310 may be manufactured in various forms. For example, the tobacco rod 310 may be formed as a sheet or a strand. Also, the tobacco rod 310 may be formed as a pipe tobacco, which is formed of tiny bits cut from a tobacco sheet.

Also, the tobacco rod 310 may be surrounded by a heat conductive material. For example, the heat-conducting material may be, but is not limited to, a metal foil such as aluminum foil. For example, the heat conductive material surrounding the tobacco rod 310 may uniformly distribute heat transmitted to the tobacco rod 310, and thus, the heat conductivity applied to the tobacco rod may be increased and taste of the tobacco may be improved. Also, the heat conductive material surrounding the tobacco rod 310 may function as a susceptor heated by the induction heater. Here, although not illustrated in the drawings, the tobacco rod 310 may further include an additional susceptor, in addition to the heat conductive material surrounding the tobacco rod 310.

The first filter segment 321 may be a cellulose acetate filter. For example, the first filter segment 321 may be a tube-type structure having a hollow inside. In other words, the first filter segment 321 may include a hollow having a first diameter, and the hollow may function as a channel through which aerosol passes. The length of the first filter segment 321 may be an appropriate length within a range of about 4 mm to about 30 mm, but is not limited thereto. Alternatively, the length of the first filter segment 321 may be 10 mm, but is not limited thereto. A diameter of the hollow included in the first filter segment 321 may be an appropriate diameter within a range of about 2 mm to about 4.5 mm, but is not limited thereto.

The second filter segment 322 cools the aerosol that is generated as the heater 13 heats the tobacco rod 310. Therefore, a user may puff the aerosol that is cooled at an appropriate temperature.

The second filter segment 322 may cool the aerosol by a phase change action. For example, a material forming the second filter segment 322 may perform a phase change action that requires absorption of heat energy, such as melting or glass transition. As an endothermic reaction occurs at a temperature at which the aerosol enters the second filter segment 322, a temperature of the aerosol passing through the second filter segment 322 is lowered.

The length or diameter of the second filter segment 322 may be variously determined according to a shape of the aerosol generating article 300. For example, the length of the second filter segment 322 may be an appropriate length within a range of about 7 mm to about 20 mm. Preferably, the length of the second filter segment 322 may be about 14 mm but is not limited thereto.

As an example, the second filter segment 322 may be formed of a polymer material or a biodegradable polymer material alone. Here, examples of the polymer material may include, but are not limited to, gelatin, polyethylene (PE), polypropylene (PP), polyurethane (PU), fluorinated ethylene propylene (FEP), and combinations thereof. Also, examples of the biodegradable polymer material may include, but are not limited to, polylactic acid (PLA), polyhydroxybutyrate (PHB), cellulose acetate, poly-epsilon-caprolactone (PCL), polyglycolic acid (PGA), polyhydroxyalkanoate (PHAs), and starch-based thermoplastic resin.

In detail, the second filter segment 322 may be formed of pure polylactic acid alone. For example, the second filter segment 322 may have a three-dimensional structure manufactured by using one or more fiber strands (hereinafter referred to as fiber strands) formed of pure polylactic acid. Here, the thickness, length, number, and shape of the fiber strands constituting the second filter segment 322 may vary. As the second filter segment 322 is formed of pure polylactic acid, unintended materials may be prevented from being generated while the aerosol passes through the second filter segment 322.

A rear-end filter segment 323 is arranged at a rear end contacting the user's mouth during smoking. A length of the rear-end filter segment 323 may be an appropriate length within a range of about 4 mm to about 20 mm. For example, the length of the rear-end filter segment 323 may be about 12 mm but is not limited thereto.

In a process of manufacturing the rear-end filter segment 323, a flavored liquid may be sprayed onto the rear-end filter segment 323 such that a flavor may be generated by the rear-end filter segment 323. Alternatively, an additional fiber coated with a flavored liquid may be inserted into the rear-end filter segment 323. The aerosol generated in the tobacco rod 310 is cooled by passing through the second filter segment 322, and the cooled aerosol is delivered to the user through the rear-end filter segment 323. Therefore, by adding a flavoring element to the rear-end filter segment 323, an effect of enhancing the persistence of a flavor delivered to the user may be achieved.

Also, the rear-end filter segment 323 may include at least one capsule 340. Here, the capsule 340 may have a configuration in which a content liquid including a flavoring material is wrapped with a film. For example, the capsule 340 may have a spherical or cylindrical shape.

Another example of an aerosol generating article 400 will now be described with reference to FIG. 5.

Figure 5:
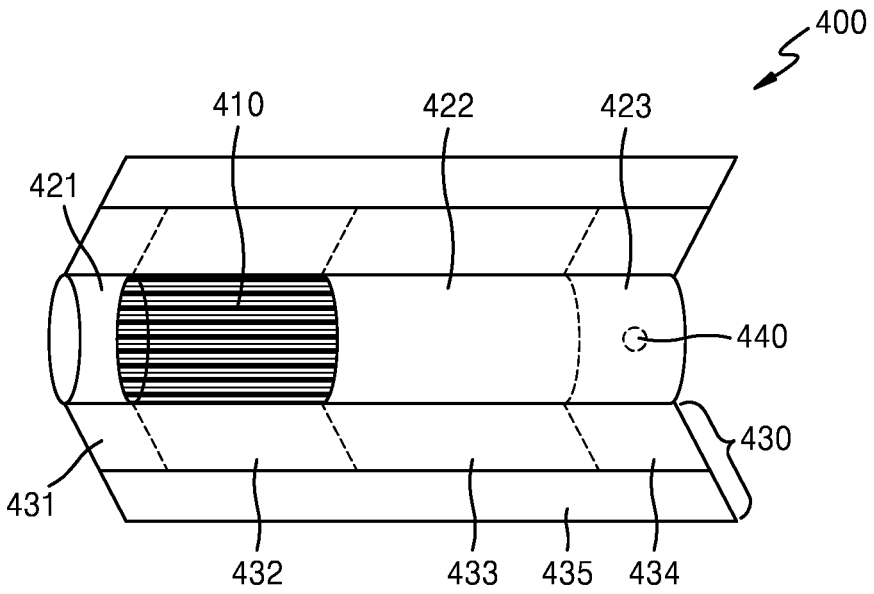

Referring to FIG. 5, the aerosol generating article 400 includes a front-end filter segment 421, a tobacco rod 410, an intermediate filter segment 422, and a rear-end filter segment 423. The first portion described above with reference to FIGS. 1 through 3 may include the front-end filter segment 421 and the tobacco rod 410, and the second portion may include the intermediate filter segment 422 and the rear-end filter segment 423.

The aerosol generating article 400 may be packaged by at least one wrapper 430. The wrapper 430 may have at least one hole through which external air may be introduced or internal air may be discharged. For example, the front-end filter segment 421 may be packaged by a first wrapper 431, the tobacco rod 410 may be packaged by a second wrapper 432, the intermediate filter segment 422 may be packaged by a third wrapper 433, and the rear-end filter segment 423 may be packaged by a fourth wrapper 434. Also, the entire aerosol generating article 400 may be repackaged by a fifth wrapper 435.

The tobacco rod 410 may correspond to the tobacco rod 310 described above with reference to FIG. 4. Therefore, hereinafter, the detailed description of the tobacco rod 410 will be omitted.

The front-end filter segment 421 is arranged toward the tobacco rod 410 at an upstream end of the aerosol generating article 400 that is inserted into the aerosol generating device 1. The front-end filter segment 421 may prevent a liquefied aerosol from flowing into the aerosol generating device 1 of FIGS. 1 through 3 from the tobacco rod 410 during smoking.

A length or diameter of the front-end filter segment 421 may be variously determined according to a shape of the aerosol generating article 400. For example, the length of the front-end filter segment 421 may be an appropriate length within a range of about 4 mm to about 20 mm. Preferably, the length of the front-end filter segment 421 may be about 7 mm but is not limited thereto. For example, the diameter of the front-end filter segment 421 may be an appropriate diameter within a range of about 4 mm to about 10 mm. Preferably, the diameter of the front-end filter segment 421 may be about 7 mm but is not limited thereto.

The intermediate filter segment 422 may be a cellulous acetate filter. For example, the intermediate filter segment 422 may be a tube-type structure having a hollow inside. In other words, the intermediate filter segment 422 may include a hollow having a first diameter, and the hollow may function as a channel through which aerosol passes. A length of the intermediate filter segment 422 may be an appropriate length within a range of about 4 mm to about 30 mm but is not limited thereto. Preferably, the length of the intermediate filter segment 422 may be 12 mm but is not limited thereto. The diameter of the hollow included in the intermediate filter segment 422 may be an appropriate diameter within a range of about 2 mm to about 4.5 mm but is not limited thereto.

The rear-end filter segment 423 is arranged at a rear end contacting the user's mouth during smoking. A length of the rear-end filter segment 423 may be an appropriate length within a range of about 4 mm to about 20 mm. For example, the length of the rear-end filter segment 423 may be about 14 mm but is not limited thereto.

In a manufacturing the rear-end filter segment 423, a flavoring liquid may be sprayed onto the rear-end filter segment 423 such that a flavor may be generated by the rear-end filter segment 423. Alternatively, an additional fiber coated with a flavored liquid may be inserted into the rear-end filter segment 423.

Also, the rear-end filter segment 423 may include at least one capsule 440. Here, the capsule 440 may have a configuration in which a content liquid including a flavoring material is wrapped with a film. For example, the capsule 440 may have a spherical or cylindrical shape.

In an aerosol generating article as described above, the rear-end filter segment 323 illustrated in FIG. 4, the front-end filter segment 421, and the rear-end filter segment 423 illustrated in FIG. 5 may have appropriate suction resistances to thereby allow aerosol to be easily puffed by the user while filter out components of the aerosol. To this end, the front-end filter segment 421 and the rear-end filter segments 323 and 423 may include at least one channel formed from an upstream end toward a downstream end and a filter structure filtering out components of an aerosol.

Figure 6:
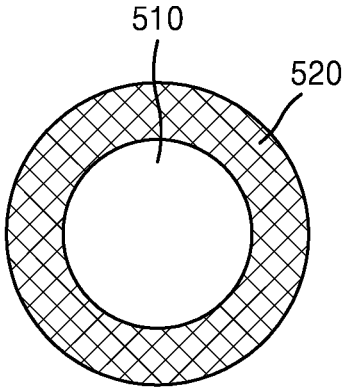
FIGS. 6 through 12 illustrate examples of radial cross-sections of a filter segment including a filter structure and a channel.

FIG. 6 illustrates an example of a lateral cross section of a filter segment including a filter structure and a channel. In other words, FIG. 6 illustrates an example of a lateral cross section of the front-end filter segment 421 or the rear-end filter segments 323 and 423 illustrated in FIGS. 4 and 5.

A filter structure 520 may be an element for filtering out some components of aerosol and may be formed of cellulose acetate.

The suction resistance of a filter segment may be adjusted by adjusting mono denier, total denier, a plasticizer content, and the like of cellulose acetate tow used for the filter structure 520. However, in this method, structural defects such as recesses may occur in acquiring appropriate suction resistance.

Front-end and rear-end filter segments may include a channel 510 to achieve appropriate suction resistance. The channel 510 passes aerosol generated in a tobacco rod or a vaporizer without filtering, and suction resistance decreases as a cross-sectional area of the channel 510 increases. In contrast, the filter structure 520 may inhibit a flow of the aerosol, and the suction resistance increases as a cross-sectional area of the filter structure 520 increases. Therefore, appropriate suction resistance may be acquired by adjusting a ratio of cross-sectional areas between a channel and a filter structure.

In an embodiment, front-end and rear-end filter segments may have suction resistance corresponding to a ratio of cross-sectional areas between a channel and a filter structure. For example, a ratio (porosity) of a cross-sectional area of a channel to a cross-sectional area of a filter structure may be within a range of about 0.02 to about 1.47. Preferably, the porosity may be included within a range of about 0.08 to about 0.5. The suction resistance of front-end and rear-end filter segments may be within a range of about 1 mmWG/mm to about 30 mmWG/mm according to porosity. Preferably, the suction resistance may be included within a range of about 8 mmWG/mm to about 12 mmWG/mm. More preferably, the suction resistance may be 10 mmWG/mm.

In addition to that illustrated in FIG. 6, a channel of the front-end and rear-end filter segments may have a different location, cross-sectional shape, and number.

Figure 7:
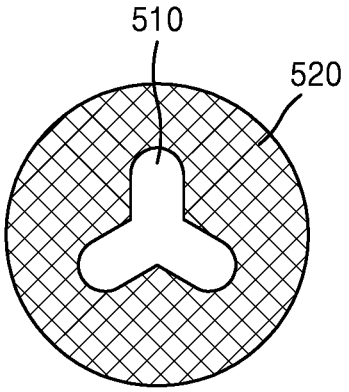
Figure 8:
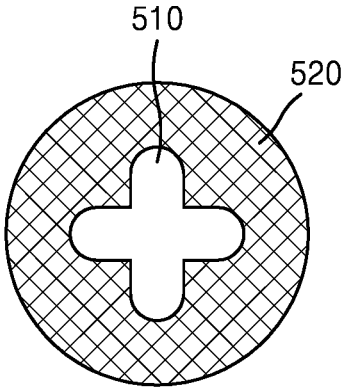

For example, a channel may be formed to have a three-leaf cross section as illustrated in FIG. 7 or a four-leaf cross section as illustrated in FIG. 8. The shape of the channel is not limited to the illustrated types, and the channel may be formed in various shapes such as a multi-leaf cross section, a polygonal shape, a heart shape, and a water droplet shape.

Channels illustrated in FIGS. 6 through 8 are formed to be located in the centers of front-end and rear-end filter segments. However, a channel may be formed to be located close to sides of segments, and locations where the channel is formed are not limited.

As another example, as illustrated in FIGS. 9 through 12, a plurality of channels 510 may be formed in the front-end and rear-end filter segments. FIGS. 9 through 12 illustrate that four or more channels are formed, but the number of channels 510 may be two or more.

Figure 9:
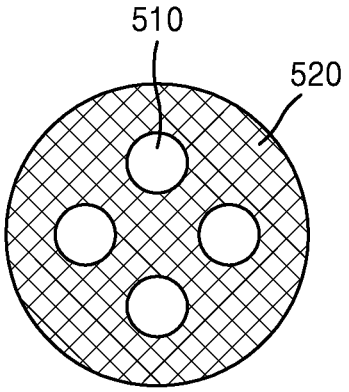
Figure 10:
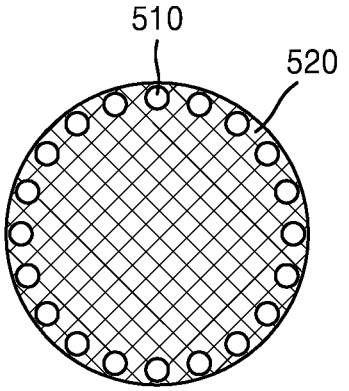
Figure 11:
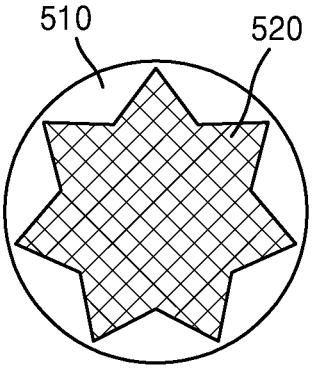
Figure 12:
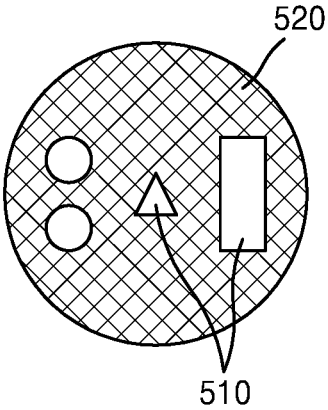

The plurality of channels 510 may be formed radially in the front-end and rear-end filter segments. For example, the plurality of channels 510 may be formed near a central portion as illustrated in FIG. 9 or may be formed near a side as illustrated in FIGS. 10 and 11. Alternatively, as illustrated in FIG. 12, the plurality of channels 510 may be formed at random locations without rules.

Alternatively, as illustrated in FIG. 11, the plurality of channels 510 may be arranged between a filter structure 520 and a wrapper surrounding the front-end and rear-end filter segments. As illustrated in FIG. 11, the filter structure 520 may include a plurality of leg portions that face outwards from the center of the filter structure 520 and extend between the plurality of channels 510. In other words, a cross-sectional shape of the filter structure 520 may be a kind of sawtooth shape. FIG. 11 illustrates seven channels 510 and seven leg portions, but a filter segment may include fewer or more than seven channels 510 and leg portions of the filter structure 520. A filter segment illustrated in FIG. 11 may be a front-end filter segment.

Also, the plurality of channels 510 may be formed in a circular shape as illustrated in FIGS. 9 and 10 or may be formed in a fan shape as illustrated in FIG. 11. Alternatively, the plurality of channels 510 may be formed in irregular shapes as illustrated in FIG. 12. The shape of a plurality of channels is not limited to the illustrated types.

Also, as illustrated in FIGS. 9 through 11, the plurality of channels 510 may be formed to have the same cross-sectional area. Alternatively, as illustrated in FIG. 12, the plurality of channels 510 may be formed to have different cross-sectional areas.

As described above, the suction resistance of an aerosol generating article may be adjusted by adjusting a ratio (porosity) of a cross-sectional area of a channel to a cross-sectional area of a filter structure. To embody desired suction resistance, various shapes, areas, and numbers of channels may be employed, and an aerosol path may be adjusted by adjusting locations of the front-end and rear-end filter segments.

A longitudinal cross section of a channel in a longitudinal direction will now be described.

Figure 13:
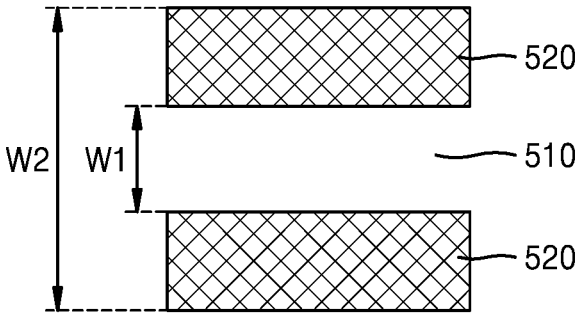
FIGS. 13 through 15 illustrate examples of a longitudinal cross section of a filter segment including a filter structure and a channel.

FIG. 13 illustrates an example of a longitudinal cross section of a filter segment including a filter structure and a channel. In other words, FIG. 13 illustrates an example of a longitudinal cross section of the front-end filter segment 421 or the rear-end filter segments 323 and 423 illustrated in FIGS. 4 and 5.

A channel 510 may be formed parallel to a longitudinal direction. In other words, a boundary line between the channel 510 and a filter structure 520 may be formed to be parallel to the longitudinal direction, and the channel 510 may be formed to have a constant width.

A ratio of a width W1 of the channel 510 to a diameter W2 of a filter segment may be included within a range of about 0.05 to about 0.9. Alternatively, the ratio of the width W1 of the channel 510 to the diameter W2 of the filter segment may be included within a range of about 0.2 to about 0.7 but is not limited to the above range. For example, when the diameter W2 of the filter segment is 7 mm, the width W1 of the channel 510 may be included within a range of about 0.05 mm to about 6.3 mm or a range of about 1.4 mm to about 4.9 mm.

Also, the channel 510 may be formed such that a cross-sectional area thereof at one point is different from a cross-sectional area thereof at another point. For example, as illustrated in FIG. 14, a longitudinal cross sectional of a channel 510 may have a tapered shape, and a cross-sectional area of the channel 510 may gradually increase toward the longitudinal direction.

Figure 14:
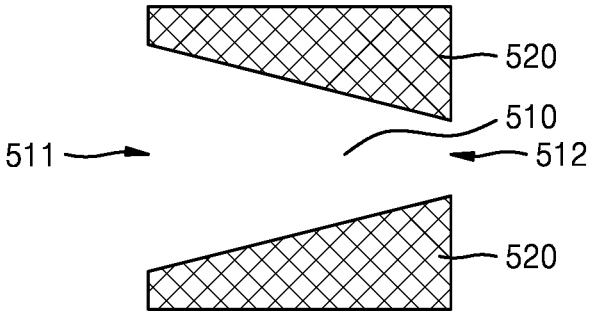

Also, as illustrated in FIG. 14, an area of the opening 511 at the upstream end of the channel 510 may be larger than an area of the opening 512 at the downstream end. The front-end filter segment 431 illustrated in FIG. 5 may allow aerosol to easily flow downstream during smoking, prevent the tobacco rod 410 from being detached, and prevent the liquefied aerosol from flowing into the aerosol generating device 1 of FIGS. 1 through 3 from the tobacco rod 410 during smoking. Therefore, the area of the upstream-end opening 511 may be formed larger such that the aerosol may be easily introduced into the channel 510. Also, the area of the downstream-end opening 512 may be formed smaller to prevent the tobacco rod 410 from being detached and prevent the liquefied aerosol from flowing into the aerosol generating device 1.

Figure 15:
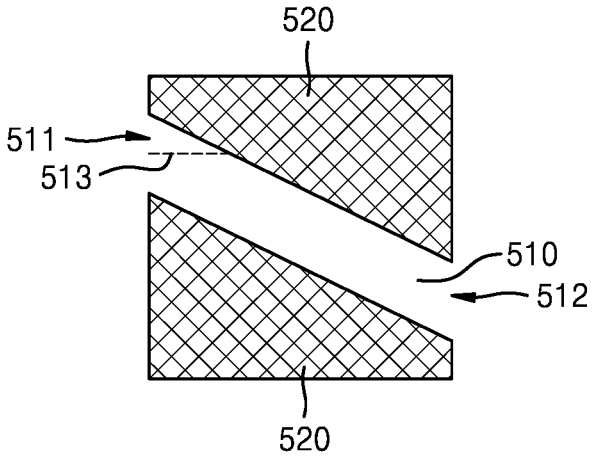

Alternatively, as illustrated in FIG. 15, a channel 510 may be formed such that a normal 513 of a channel opening 511 meets a filter structure 520. In other words, the channel 510 may be formed obliquely with respect to a longitudinal direction. When the channel 510 is formed as described above in consideration of the function of the front-end filter segment 421 illustrated in FIG. 5, even if the tobacco rod 410 or a liquefied aerosol is introduced in the direction of a normal of openings 511 and 512, the tobacco rod 410 or the liquefied aerosol may be blocked by the filter structure 520. Therefore, the tobacco rod 410 or the liquefied aerosol may be prevented from being discharged into the aerosol generating device 1 of FIGS. 1 through 3.

Figure 16:
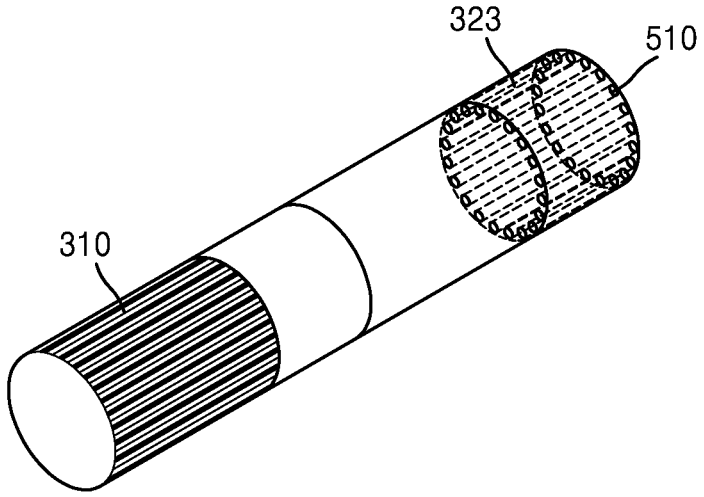
FIG. 16 illustrates an example of an aerosol generating article in which a channel is formed in a rear-end filter segment.

FIG. 16 illustrates an example of an aerosol generating article including a channel formed in a rear-end filter segment. FIG. 16 illustrates an aerosol generating article in which a plurality of channels of FIG. 10 are formed in a rear-end filter segment of FIG. 4.

When a user puffs while holding the rear-end filter segment 323 by the mouth of the user, aerosol formed in the tobacco rod 310 or a vaporizer passes through the rear-end filter segment 323 and is delivered to the user. In an embodiment, suction resistance that enables the user to easily puff aerosol may be acquired by forming a plurality of channels 510 having appropriate cross-sectional areas in the rear-end filter segment 323. Also, a movement path of the aerosol may be controlled by allowing the aerosol to naturally flow along the plurality of channels 510 formed close to a side. Similarly, a plurality of channels may also be formed in the rear-end filter segment 423 illustrated in FIG. 5.

Figure 17:
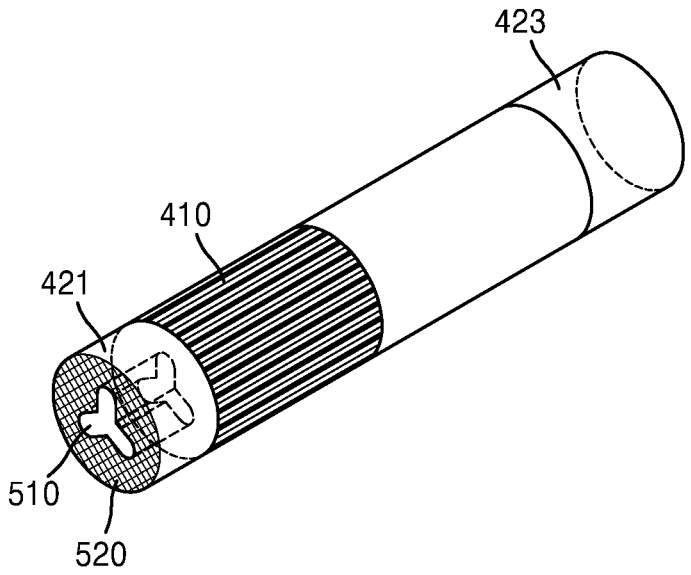
FIG. 17 illustrates an example of an aerosol generating article in which a channel is formed in a front-end filter segment.

FIG. 17 illustrates an example of an aerosol generating article in which a channel is formed in a front-end filter segment. FIG. 17 illustrates an aerosol generating article in which a channel of FIG. 7 is formed in a front-end filter segment of FIG. 5.

When a user starts smoking, aerosol flows downstream, but some of liquefied aerosol may leak upstream. A front-end filter segment 421 may be arranged at the upstream side of a tobacco rod 410 to thereby prevent the tobacco rod 410 from being detached and prevent liquefied aerosol from flowing into the aerosol generating device 1. Also, a channel 510 may be formed in the front-end filter segment 421 to embody appropriate suction resistance for a user to puff aerosol generated in the vaporizer 14 of FIGS. 2 and 3.

Figure 18:
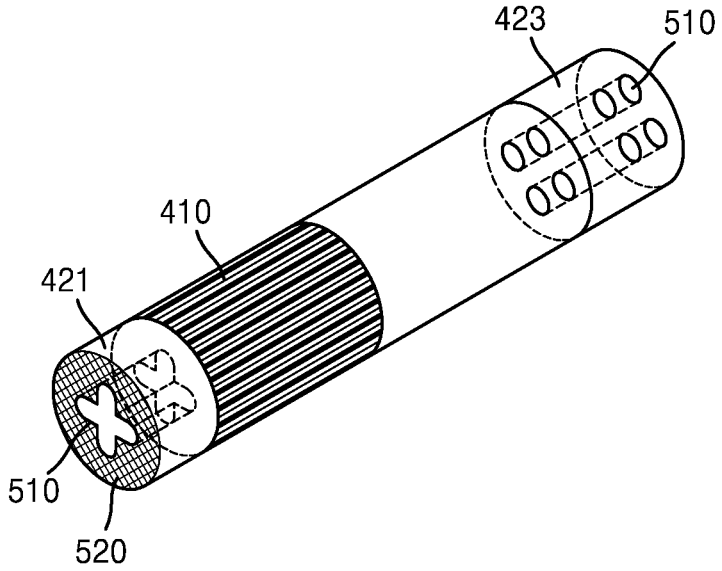
FIG. 18 illustrates an example of an aerosol generating article in which channels are formed in a front-end filter segment and a rear-end filter segment.

FIG. 18 illustrates an example of an aerosol generating article in which channels are formed in a front-end filter segment and a rear-end filter segment. FIG. 18 illustrates an aerosol generating article in which a channel of FIG. 8 is formed in a front-end filter segment of FIG. 5 while channels of FIG. 9 are formed in a rear-end filter segment.

The functions of channels formed in front-end and rear-end filter segments are described above with reference to FIGS. 16 and 17. The channels 510 formed in a front-end filter segment 421 and a rear-end filter segment 423 of FIG. 18 may perform the same functions as the channels formed in the front-end and rear-end filter segments of FIGS. 16 and 17. In other words, a filter structure 520 of the front-end filter segment 421 may prevent liquefied aerosol or a tobacco rod 410 from being discharged into an aerosol generating device. Also, appropriate suction resistance for a user to puff aerosol generated in the vaporizer 14 of FIGS. 2 and 3 may be acquired. In addition, appropriate suction resistance for the user to puff aerosol generated in the vaporizer 14 or the tobacco rod 410 may be acquired.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. An aerosol generating article comprising:

a front-end filter segment arranged at an upstream end that is to be inserted into an aerosol generating device;

a rear-end filter segment arranged at a downstream end that is to contact a mouth of a user; and a tobacco rod arranged between the front-end filter segment and the rear-end filter segment, wherein the front-end filter segment comprises:

at least one channel extending from the upstream end toward the downstream end; and a filter structure, wherein the front-end filter segment has suction resistance corresponding to a ratio between a cross-sectional area of the at least one channel and a cross-sectional area of the filter structure, wherein the aerosol generating device includes a vaporizer, and a heater separately provided from the vaporizer, the vaporizer and the heater being externally positioned with respect to the aerosol generating article when the aerosol generating article is inserted into the aerosol generating device, wherein the tobacco rod is positioned adjacent to the heater when the aerosol generating article is inserted into the aerosol generating device, the tobacco rod being configured to generate a first aerosol using a heat from the heater, and wherein the at least one channel is positioned such that a second aerosol generated via the vaporizer and is externally provided into the aerosol generating article passes through the aerosol generating article, and the filter structure is configured to filter out some components of the first aerosol, that is generated within the aerosol generating article, and the second aerosol, that is externally generated and provided into the aerosol generating article.

2. The aerosol generating article of claim 1, wherein the suction resistance of the front-end filter segment is within a range of 1 mmWG/mm to 30 mmWG/mm.

3. The aerosol generating article of claim 1, wherein the ratio of the cross-sectional area of the at least one channel to the cross-sectional area of the filter structure is within a range of 0.02 to 1.47.

4. The aerosol generating article of claim 1, wherein a cross-sectional shape of the at least one channel is a circular or multi-leaf shape.

5. The aerosol generating article of claim 1, wherein the at least one channel comprises a plurality of channels, the plurality of channels are arranged between the filter structure and a wrapper surrounding the front-end filter segment, and the filter structure comprises a plurality of leg portions that extend from a center of the filter structure between the plurality of channels.

6. The aerosol generating article of claim 1, wherein the at least one channel comprises a plurality of channels, and the plurality of channels are different in at least one of a location, a cross-sectional shape, or a cross-sectional area.

7. The aerosol generating article of claim 1, wherein a cross-sectional area of the at least one channel at one point is different from a cross-sectional area of the at least one channel at another point.

8. The aerosol generating article of claim 7, wherein an area of an upstream-end opening of the at least one channel is greater than an area of a downstream-end opening of the at least one channel.

9. The aerosol generating article of claim 1, wherein a normal of an opening of the at least one channel meets the filter structure.

10. The aerosol generating article of claim 1, wherein the rear-end filter segment comprises at least one channel, and the at least one channel formed in the front-end filter segment and the at least one channel formed in the rear-end filter segment are different in at least one of a cross-sectional shape, a cross-sectional area, or a number.

11. An aerosol generating article comprising:

a tobacco rod arranged at an upstream end that is to be inserted into an aerosol generating device; and a rear-end filter segment arranged at a downstream end that is to contact a mouth of a user, wherein the rear-end filter segment comprises:

at least one channel extending from the upstream end toward the downstream end; and a filter structure, wherein the rear-end filter segment has a suction resistance corresponding to a ratio between a cross-sectional area of the at least one channel and a cross-sectional area of the filter structure, wherein the aerosol generating device includes a vaporizer, and a heater separately provided from the vaporizer, the vaporizer and the heater being externally positioned with respect to the aerosol generating article when the aerosol generating article is inserted into the aerosol generating device, wherein the tobacco rod is positioned adjacent to the heater when the aerosol generating article is inserted into the aerosol generating device, the tobacco rod being configured to generate a first aerosol using a heat from the heater, and wherein the at least one channel is positioned such that a second aerosol generated via the vaporizer and is externally provided into the aerosol generating article passes through the aerosol generating article, and the filter structure is configured to filter out some components of the first aerosol, that is generated within the aerosol generating article, and the second aerosol, that is externally generated and provided into the aerosol generating article.

* * * * *